US010619334B2

(12) United States Patent
Varma

(10) Patent No.: US 10,619,334 B2
(45) Date of Patent: Apr. 14, 2020

(54) TUB SPOUT WITH FLEXIBLE PORTION AND INFLEXIBLE PORTION

(71) Applicant: Kohler Co., Kohler, WI (US)

(72) Inventor: Shashank Varma, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 31 days.

(21) Appl. No.: 16/000,128

(22) Filed: Jun. 5, 2018

(65) Prior Publication Data

US 2019/0368171 A1 Dec. 5, 2019

(51) Int. Cl.
*E03C 1/04* (2006.01)

(52) U.S. Cl.
CPC ..... *E03C 1/0404* (2013.01)

(58) Field of Classification Search
CPC ..... E03C 1/0404; A47K 3/005; F16L 59/168
See application file for complete search history.

(56) References Cited

U.S. PATENT DOCUMENTS

| | | | | |
|---|---|---|---|---|
| 2,171,023 | A | 8/1939 | Buxton | |
| 3,387,816 | A * | 6/1968 | Holycross | F16K 3/02 251/175 |
| 3,443,266 | A * | 5/1969 | Mongerson | F16L 5/00 4/677 |
| 3,520,325 | A | 7/1970 | Stuart | |
| 3,739,806 | A | 6/1973 | Bucknell et al. | |
| 3,765,455 | A | 10/1973 | Countryman | |
| 3,784,235 | A * | 1/1974 | Kessler | B29C 65/5057 285/94 |
| 3,871,406 | A | 3/1975 | Anderson | |
| 4,084,620 | A | 4/1978 | Martir | |
| 6,119,286 | A | 9/2000 | Briscoe | |
| 6,775,866 | B1 | 8/2004 | Martir et al. | |
| 7,344,094 | B1 * | 3/2008 | Tracy | B05B 1/1627 239/588 |
| D567,384 | S | 4/2008 | Sakulsacha et al. | |
| 7,588,197 | B2 | 9/2009 | Finell | |
| 8,276,615 | B2 * | 10/2012 | Weber | E03C 1/086 137/625.46 |
| 8,424,559 | B2 | 4/2013 | Huang | |
| 8,439,074 | B2 | 5/2013 | Farag | |
| 8,566,975 | B1 * | 10/2013 | Lin | F16K 3/0218 137/801 |
| 2008/0083844 | A1 | 4/2008 | Leber | |
| 2008/0196159 | A1 * | 8/2008 | Lee | E03C 1/0404 4/678 |
| 2011/0186163 | A1 | 8/2011 | Farag | |
| 2017/0356169 | A1 | 12/2017 | Shay et al. | |

* cited by examiner

*Primary Examiner* — Janie M Loeppke
(74) *Attorney, Agent, or Firm* — Foley & Lardner LLP

(57) ABSTRACT

A tub spout includes a fitting, an inflexible portion, and a flexible portion. The fitting is configured to be coupled to a plumbing fixture and to receive water from the plumbing fixture. The inflexible portion is configured to receive the fitting or configured to have the fitting integrated therein, be held adjacent a wall by the plumbing fixture, and receive the water from the plumbing fixture. The flexible portion is configured to be coupled to and extend from the inflexible portion, selectively receive the water from the inflexible portion, and selectively provide the water out of the tub spout.

18 Claims, 4 Drawing Sheets

TUB SPOUT WITH FLEXIBLE PORTION AND INFLEXIBLE PORTION

BACKGROUND

The present application relates generally to a tub spout. In particular, this application relates to a tub spout which includes a flexible portion and an inflexible portion.

Water is selectively provided from a plumbing connection to a spout and into a structure such as a tub. Generally speaking, a spout is attached to a wall such that the spout protrudes from the wall. Due to the protruding nature of the spout from the wall, the spout can unintentionally or accidentally contact a portion of a person's body, such as the leg, head, arm, or torso of a person. This contact can be unpleasant for the person and/or can damage the spout if the spout is entirely inflexible. Accordingly, it is desirable to construct a spout with a portion that is flexible.

SUMMARY

One embodiment of the present disclosure is related to a tub spout. The tub spout includes a fitting, an inflexible portion, and a flexible portion. The fitting is configured to be coupled to a plumbing fixture and to receive water from the plumbing fixture. The inflexible portion is configured to receive the fitting or configured to have the fitting integrated therein, be held adjacent a wall by the plumbing fixture, and receive the water from the plumbing fixture. The flexible portion is configured to be coupled to and extend from the inflexible portion, selectively receive the water from the inflexible portion, and selectively provide the water out of the tub spout.

Another embodiment of the present disclosure is related to a tub spout. The tub spout includes an inflexible portion, a flexible portion, and a diverter assembly. The inflexible portion is configured to be held adjacent a wall. The inflexible portion includes a fitting configured to be coupled to a plumbing fixture and to receive water from the plumbing fixture. The fitting is configured to hold the inflexible portion adjacent the wall through the plumbing fixture. The flexible portion is configured to be coupled to and extend from the inflexible portion, selectively receive the water from the inflexible portion, and selectively provide the water out of the tub spout. The diverter assembly is coupled to the inflexible portion. The diverter assembly includes a gate positioned within the inflexible portion. The gate is operable between a first position where the water is capable of flowing from the flexible portion to the inflexible portion and a second position where the water is prohibited from flowing from the flexible portion to the inflexible portion.

Yet another embodiment of the present disclosure is related to a tub spout. The tub spout includes an inflexible portion, a flexible portion, and a diverter assembly. The inflexible portion is configured to be coupled to a plumbing fixture, receive water from the plumbing fixture, and be held adjacent a wall through the plumbing fixture. The inflexible portion includes a first groove extending about the inflexible portion. The flexible portion is configured to be coupled to and extend from the inflexible portion, selectively receive the water from the inflexible portion, and selectively provide the water out of the tub spout. The flexible portion includes a first protrusion extending about the flexible portion. The diverter assembly is coupled to the inflexible portion and operable between a first position where water is capable of being provided from the inflexible portion to the flexible portion and a second position where water is prohibited from being provided from the inflexible portion to the flexible portion. The first groove is configured to receive the first protrusion such that the flexible portion is coupled to the inflexible portion.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

I. Overview

A tub spout protrudes from a wall and may contact a portion of a person's body. A tub spout may be made from inflexible material such as bronze, brass, aluminum, or other similar metals. If a person slips in a bath tub, a portion of that person's body may contact such a tub spout as the person falls. This contact may be unpleasant to the person and/or may cause damage to the tub spout because the tub spout is incapable of elastically deforming due to the inflexible nature of the tub spout.

Various embodiments herein relate to a tub spout that includes a flexible portion and an inflexible portion. The inflexible portion is coupled to a plumbing fixture and held against a wall while the flexible portion is attached to the inflexible portion and extends therefrom. The inflexible portion receives water from the plumbing fixture and provides the water to the flexible portion which provides the water from the tub spout (e.g., into a bathtub, etc.). The flexible portion is configured to elastically deform while the inflexible portion is configured to not elastically deform. In this way, the tub spout described herein has the benefits associated with flexibility, such as mitigating injury to a person due to contact with the tub spout, and the benefits associated with inflexibility, such as attaining a desired aesthetic appearance and mitigating leakage with the plumbing fixture.

II. The Tub Spout having a Flexible Portion and an Inflexible Portion

Figure 1:
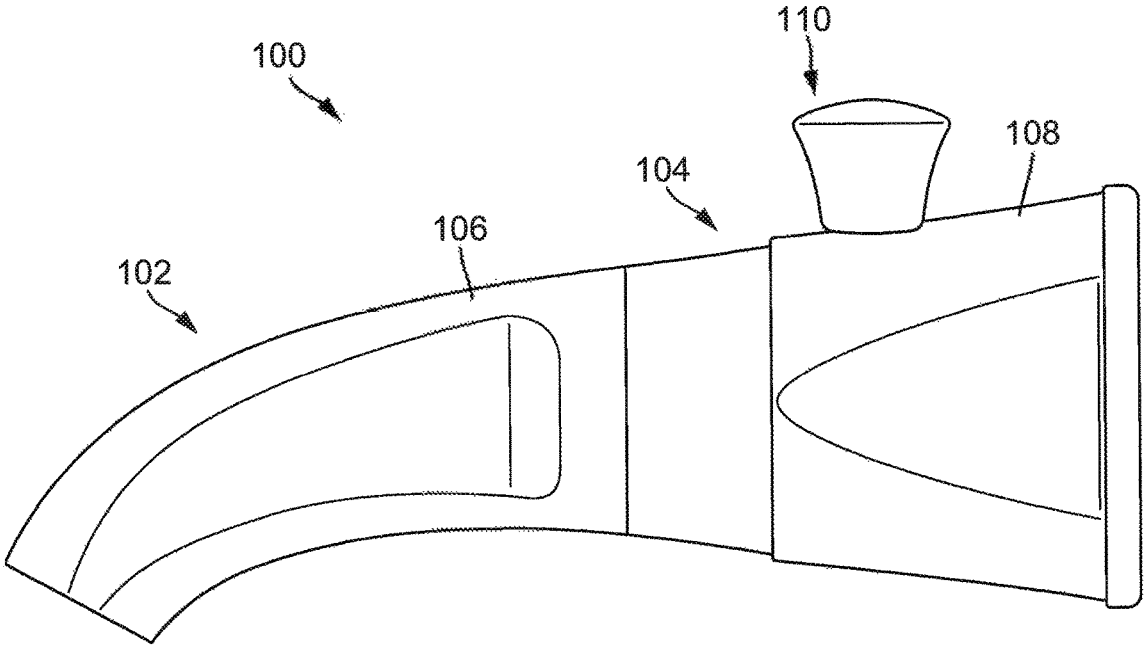
FIG. 1 is a side view of a tub spout having a flexible portion and an inflexible portion, according to an exemplary embodiment of the present disclosure.

Referring to FIG. 1, a spout (e.g., bathtub spout, Jacuzzi spout, water spout, wall-mount spout, etc.), shown as a tub spout 100, is illustrated. The tub spout 100 is configured to be mounted on a wall (e.g., shower wall, bathroom wall, tub wall, etc.). In various embodiments, the tub spout 100 is mounted on a bathroom wall above a tub. The tub spout 100 is configured to receive water (e.g., a mixture of hot and cold water, hot water, cold water, etc.) from a plumbing fixture (e.g., fitting, etc.) and to selectively provide the water to a tub (e.g., basin, Jacuzzi, etc.). As will be described in more detail herein, the tub spout 100 is operable between a first state (e.g., tub flow, etc.), where water is provided to the tub, and a second state, where water is diverted from the tub spout 100 (e.g., to a shower head, etc.).

The tub spout 100 includes a first portion (e.g., piece, body, etc.), shown as a flexible portion 102, and a second portion (e.g., piece, body, etc.), shown as an inflexible portion 104. The flexible portion 102 is coupled to (e.g., attached to, joined with, etc.) the inflexible portion 104. The inflexible portion 104 is coupled to the wall. In this way, the flexible portion 102 is coupled to the wall through the inflexible portion 104.

The flexible portion 102 is configured to elastically deform (e.g., have an initial shape, bend due to force on the flexible portion 102, and return to the initial shape once the force on the flexible portion 102 is removed, etc.). The inflexible portion 104 is not configured to elastically deform. The tub spout 100 is configured such that the inflexible portion 104 is maintained closest to the wall. In this way, the risk that a person would unintentionally contact the inflexible portion 104 is minimized.

The tub spout 100 includes both the flexible portion 102 and the inflexible portion 104 because each provides the tub spout 100 with important benefits. The inflexible portion 104 minimizes or eliminates leakage between the plumbing fixture and the tub spout 100. Spouts which are entirely flexible, and do not include a portion like the inflexible portion 104, may require multiple seals, such as seals between inflexible interior components and the flexible outer components, which are undesirable.

It may also be difficult to maintain an entirely flexible spout relative to a wall. The flexible portion 102 allows the outermost portion of the tub spout to deform if contacted by a portion of a person's body. For example, if a person slips, falls, and hits the flexible portion 102, the flexible portion 102 may deform, thereby minimizing injury to the person. The flexible portion 102 extends from the wall and is desirable due to its ability to deliver water into a tub in a desirable manner (e.g., away from the wall, at a target angle, etc.), compared to spouts which do not extend from a wall.

Additionally, the flexible portion 102 is configured to be detached from the inflexible portion 104 without damaging the flexible portion 102 or the inflexible portion 104. In this way, when a force applied to the flexible portion 102 is too great, the flexible portion 102 may become detached from the inflexible portion 104, thereby preventing damage to the inflexible portion 104 and associated components (e.g., a diverter assembly, plumbing fitting, etc.). In contrast, an entirely flexible spout may not include a portion which can detach. As a result, when a relatively large force is applied to an entirely flexible spout, the entirely flexible spout may become undesirable.

Furthermore, the use of the flexible portion 102 and the inflexible portion 104 provides aesthetic benefits along with the aforementioned safety benefits. The inflexible portion 104 is capable of having an aesthetic appearance which the flexible materials may not easily (e.g., relatively inexpensively, etc.) have. For example, the inflexible portion 104 may be chrome plated, have a brushed aluminum or bronze appearance, or have a gloss, oil rubbed, antique, or reflective appearance. Such appearance may be difficult (e.g., relatively expensive, etc.) or impossible for flexible materials to attain. For example, it is difficult for flexible materials to have a chrome plated appearance. As a result, the inflexible portion 104 is capable of having an aesthetic appearance which is different from that of the flexible portion 102. In various embodiments herein, the flexible portion 102 is made from a first material and has a first aesthetic quality and the inflexible portion 104 is made from a second material, different from the first material, and has a second aesthetic quality, different from the first aesthetic quality. In an exemplary embodiment, the flexible portion 102 is made from a dyed silicone (e.g., a black silicone, etc.) and the inflexible portion 104 is chrome plated.

As an additional benefit, the tub spout 100 can be easily reconfigured with flexible portions 102 having different shapes, sizes, and/or aesthetic appearances. For example, a user can easily interchange a flexible portion 102 having one aesthetic appearance (e.g., white dyed silicone, etc.) for a flexible portion 102 having another aesthetic appearance (e.g., black dyed silicone, etc.). Such interchanging would be relatively inexpensive for the user, because the user would not have to repurchase the inflexible portion 104 and components associated therewith, and relatively quick, because the user would not have to uninstall the entire tub spout 100 and reinstall a new tub spout 100.

In an example embodiment, the flexible portion 102 is rubber, silicone, neoprene, or foam and the inflexible portion 104 is metal (e.g., aluminum, stainless steel, brass, etc.), plastic (e.g., acrylonitrile butadiene styrene (ABS) plastic, engineered plastic, etc.), or ceramic. In some embodiments, the flexible portion 102 is configured to be constructed from anti-microbial and/or anti-bacterial silicone, such as neutra-Sil™, StatSil™, and Stericone.

The flexible portion 102 is defined by a surface, shown as an exterior surface 106. The exterior surface 106 may have a target (e.g., desired, intended, etc.) surface finish and roughness. For example, the exterior surface 106 may be painted (e.g., white, black, chrome, etc.) or the flexible portion 102 may be dyed to attain a target color or appearance. Similarly, the inflexible portion 104 is defined by a surface, shown as an exterior surface 108. The exterior surface 108 may have a target surface finish and roughness. For example, the exterior surface 108 may be painted or the inflexible portion may be dyed to attain a target color or appearance. In some embodiments, the exterior surface 108 is plated (e.g., chrome plated, etc.) or has a brushed metal (e.g., brushed aluminum, brushed bronze, etc.) or oil rubbed appearance.

As will be described in more detail herein, the tub spout 100 includes a member (e.g., component, piece, etc.), shown as a diverter knob 110. The diverter knob 110 is operable between a first state, where the diverter knob 110 facilitates the passage of water through the tub spout 100 (e.g., from an inlet of the tub spout 100 and out of an outlet of the tub spout 100, etc.), and a second state, where the diverter knob 110 prohibits the passage of water through the tub spout 100.

Figure 2:
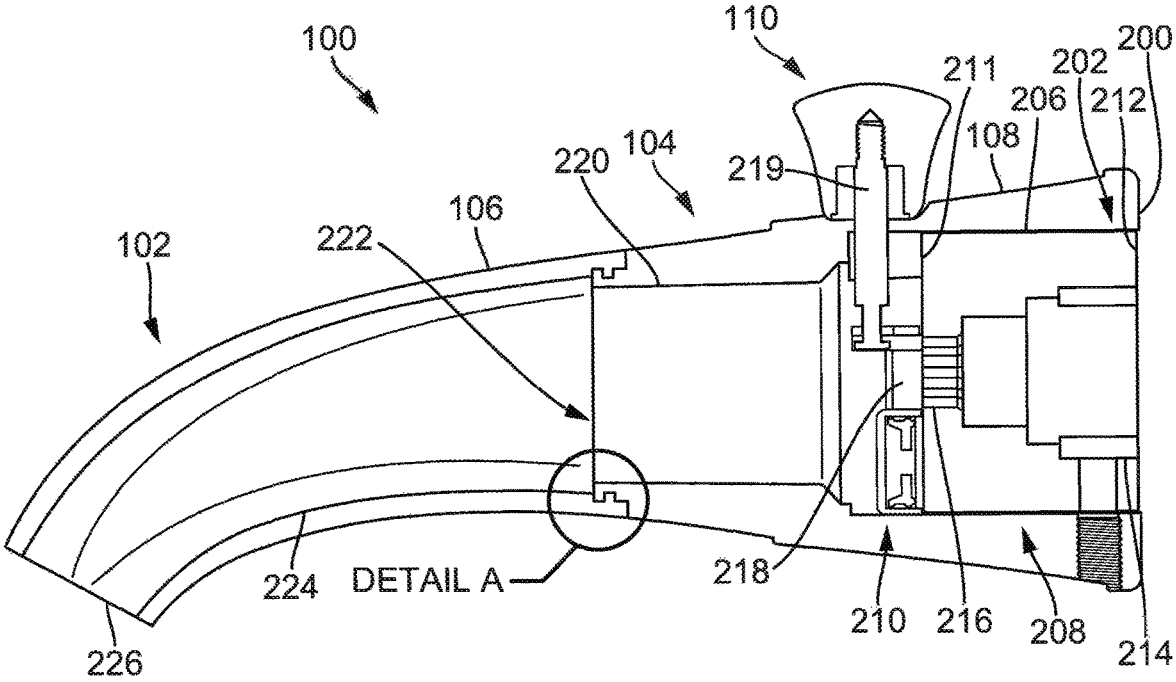
FIG. 2 is a cross-sectional view of the tub spout of FIG. 1.

FIG. 2 is a cross-sectional view of the tub spout 100. The tub spout 100 includes a face (e.g., surface, end, etc.), shown as a mounting face 200. The mounting face 200 is configured to be mounted against a wall (e.g., surface, etc.). For example, the mounting face 200 may be configured to be mounted flush against the wall (e.g., substantially without any gap existing between the mounting face 200 and the wall, etc.).

The tub spout 100 also includes a receiver (e.g., recession, receptacle, etc.), shown as a receiver 202. The receiver 202 is contiguous with (e.g., shares a border with, etc.) the mounting face 200. The receiver 202 is defined by a surface (e.g., annular surface, etc.), shown as an inner surface 206. Specifically, the inner surface 206 is contiguous with the mounting face 200. In various embodiments, the receiver 202 is cylindrical. However, the receiver 202 may be square, rectangular, hexagonal, or otherwise shaped so that the tub spout 100 is tailored for a target application.

The receiver 202 is configured to receive a fitting (e.g., engine, connection, etc.), shown as a fitting 208, and an assembly (e.g., system, etc.), shown as a diverter assembly 210. The fitting 208 is inserted into the receiver 202 such that an external surface of the fitting 208 interfaces with the inner surface 206. In various embodiments, the receiver 202 is overmolded over the fitting 208 such that the interface between the fitting 208 and the receiver 202 is substantially water-tight (e.g., such that water is prevented from passing between the fitting 208 and the receiver 202, etc.).

When assembled, the fitting 208 is biased against a surface, shown as an inner wall 211, of the inflexible portion 104. The fitting 208 includes a surface, shown as an interfacing surface 212, is configured to be mounted flush against the wall (e.g., substantially without any gap existing between the interfacing surface 212 and the wall, etc.).

The fitting 208 includes an input (e.g., opening, aperture, recession, etc.), shown as an input 214. The input 214 is configured to receive a component (e.g., plumbing fixture, threaded fitting, etc.) of a plumbing system associated with a target installation for the tub spout 100. For example, the input 214 may be threaded (e.g., threaded according to National Pipe Thread (NPT) standards, etc.) and configured to receive a threaded pipe of the plumbing fixture. The fitting 208 also includes an output (e.g., opening, aperture, etc.), shown as an outlet 216. The input 214 is configured to receive water (e.g., a mixture of hot water and cold water, hot water, cold water, etc.) from the fitting. The outlet 216 is configured to receive the water from the input 214 and provide the water to the diverter assembly 210.

The diverter assembly 210 includes a gate (e.g., plate, member, component, etc.), shown as a gate 218. The gate 218 is configured to selectively block the outlet 216 such that the water from the fitting cannot be provided from the outlet 216 (e.g., into the remainder of the tub spout 100, etc.). The gate 218 is coupled to the diverter knob 110 via a shaft (e.g., rod, connector, etc.), shown as a shaft 219. The shaft 219 protrudes through an aperture in the inflexible portion 104.

The gate 218 is configured to be selectively repositionable within the inflexible portion 104 by selective repositioning of the diverter knob 110. Specifically, the diverter knob 110 is operable between a first state, where the diverter knob 110 is maintained in contact with, or proximate to, the exterior surface 108 of the inflexible portion 104, and where the gate 218 facilitates passage of water from the outlet 216, and a second state, where the diverter knob 110 is elevated from the exterior surface 108 of the inflexible portion 104, and the gate 218 prohibits the passage of water.

Using the diverter knob 110, a user may cause water to be provided from the tub spout 100 by depressing the diverter knob 110 or a user may cause water to be prohibited from being provided from the tub spout 100 (e.g., an instead cause the water to be provided from a shower head, etc.) by lifting the diverter knob 110. In other embodiments, the gate 218 and the diverter knob 110 are configured such that lifting the diverter knob 110 facilitates passage of water from the outlet 216 and depressing the diverter knob 110 prohibits passage of water from the outlet 216.

The inflexible portion 104 includes a channel (e.g., passageway, etc.), shown as a channel 220. The channel 220 is positioned adjacent the gate 218 and is configured to receive water from the gate 218 (e.g., when the gate 218 facilitates the passage of water therethrough, etc.). The channel 220 defines an outlet, shown as an outlet 222, of the inflexible portion 104.

The flexible portion 102 includes a channel, shown as a channel 224. The channel 224 is configured to be aligned with the channel 220 when the flexible portion 102 is coupled to the inflexible portion 104. The channel 224 is configured to receive water from the channel 220 and provide the water from the tub spout 100 via an outlet, shown as an outlet 226.

Figure 3:
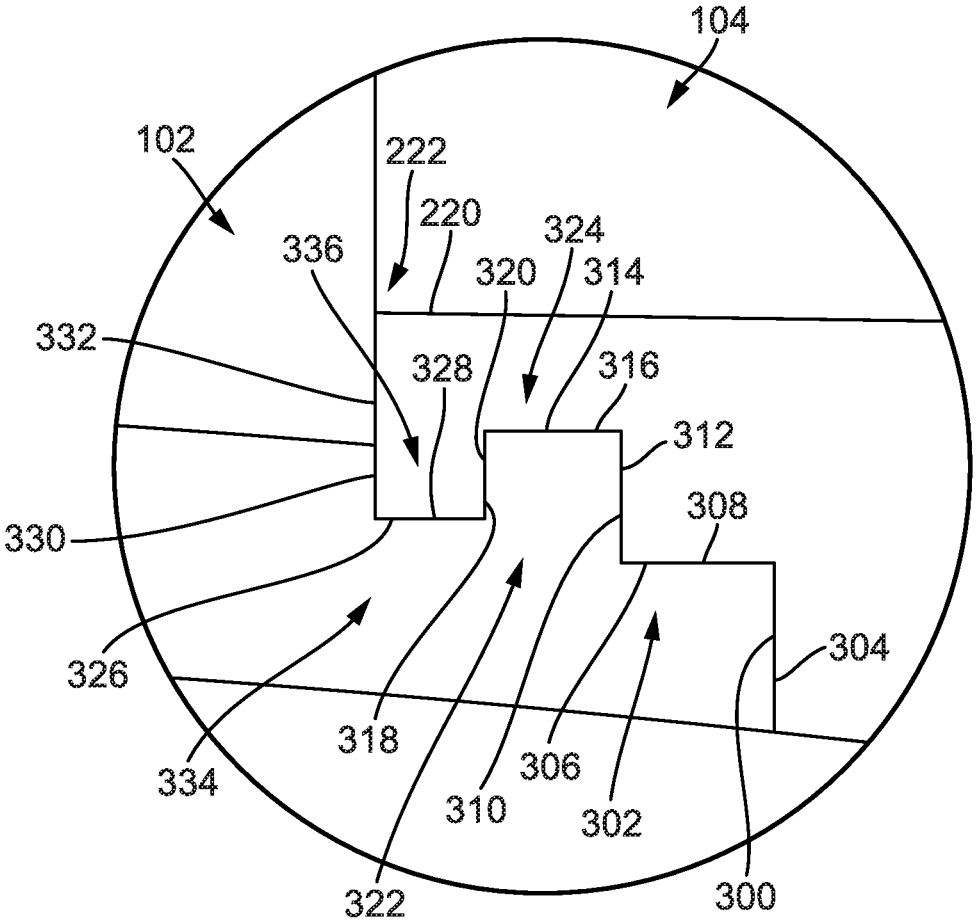
FIG. 3 is a view of DETAIL A from FIG. 2.

FIG. 3 illustrates DETAIL A from FIG. 2. The flexible portion 102 includes a surface, shown as an end face 300, and an opening, shown as an inlet 302. As will be explained in more detail herein, the inlet 302 is configured to receive a portion of the inflexible portion 104 such that the inflexible portion 104 may be coupled to the flexible portion 102. The end face 300 is contiguous with the exterior surface 106. The end face 300 is configured to interface with a surface, shown as an end face 304 of the inflexible portion 104. The end face 304 is contiguous with the exterior surface 108.

The flexible portion 102 also includes a surface, shown as an inner surface 306. The inner surface 306 is contiguous with the end face 300. In various embodiments, the inner surface 306 is approximately orthogonal to the end face 300. The inflexible portion 104 also includes a surface, shown as an outer surface 308. The outer surface 308 is contiguous with the end face 304 and configured to interface with the inner surface 306. In various embodiments, the outer surface 308 is orthogonal to the end face 304.

The flexible portion 102 also includes a surface, shown as an end face 310. The end face 310 is contiguous with the inner surface 306. In various embodiments, the end face 310 is approximately orthogonal to the inner surface 306. The inflexible portion 104 also includes a surface, shown as an end face 312. The end face 312 is contiguous with the outer surface 308 and configured to interface with the end face 310. In various embodiments, the end face 312 is orthogonal to the outer surface 308.

The flexible portion 102 also includes a surface, shown as an inner surface 314. The inner surface 314 is contiguous with the end face 310. In various embodiments, the inner surface 314 is approximately orthogonal to the end face 310. The inflexible portion 104 also includes a surface, shown as an outer surface 316. The outer surface 316 is contiguous with the end face 312 and configured to interface with the inner surface 314. In various embodiments, the outer surface 316 is orthogonal to the end face 312.

The flexible portion 102 also includes a surface, shown as an end face 318. The end face 318 is contiguous with the inner surface 314. In various embodiments, the end face 318 is approximately orthogonal to the inner surface 314. The inflexible portion 104 also includes a surface, shown as an end face 320. The end face 320 is contiguous with the outer surface 316 and configured to interface with the end face 318. In various embodiments, the end face 320 is orthogonal to the outer surface 316.

Collectively, the end face 310, the inner surface 314, and the end face 318 define a protrusion (e.g., projection, rib, tongue, etc.), shown as a protrusion 322. The end face 310, the inner surface 314, and the end face 318 are configured such that the protrusion 322 extends at least partially about the inlet 302. For example, the protrusion 322 may extend entirely about the inlet 302 such that the protrusion 322 is an annular protrusion.

Similarly, the end face 312, the outer surface 316, and the end face 320 collectively define a groove (e.g., channel, etc.), shown as a groove 324. The end face 312, the outer surface 316, and the end face 320 are configured such that the groove 324 extends at least partially about the outlet 222. For example, the groove 324 may extend entirely about the outlet 222 such that the groove 324 is an annular groove.

The flexible portion 102 also includes a surface, shown as an inner surface 326. The inner surface 326 is contiguous with the end face 318. In various embodiments, the inner surface 326 is approximately orthogonal to the end face 318. The inflexible portion 104 also includes a surface, shown as an outer surface 328. The outer surface 328 is contiguous with the end face 320 and configured to interface with the inner surface 326. In various embodiments, the outer surface 328 is orthogonal to the end face 320.

The flexible portion 102 also includes a surface, shown as an end face 330. The end face 330 is contiguous with the inner surface 326. In various embodiments, the end face 330 is approximately orthogonal to the inner surface 326. The inflexible portion 104 also includes a surface, shown as an end face 332. The end face 332 is contiguous with the outer surface 328 and configured to interface with 328 end face 330. In various embodiments, the end face 332 is orthogonal to the outer surface 316.

Collectively, the end face 318, the inner surface 326, and the end face 330 collectively define a groove, shown as a groove 334. The end face 318, the inner surface 326, and the end face 330 are configured such that the groove 334 extends at least partially about the inlet 302. For example, the groove 334 may extend entirely about the inlet 302 such that the groove 334 is an annular groove.

Similarly, the end face 320, the outer surface 328, and the end face 332 define a protrusion, shown as a protrusion 336. The end face 320, the outer surface 328, and the end face 332 are configured such that the protrusion 336 extends at least partially about the outlet 222. For example, the protrusion 336 may extend entirely about the outlet 222 such that the protrusion 336 is an annular protrusion.

The flexible portion 102 is configured to be coupled to the inflexible portion 104 by locating the protrusion 322 in the groove 324 and by locating the protrusion 336 in the groove 334. The protrusion 322 and the groove 324 are configured to cooperate to prevent axial displacement (e.g., movement, etc.) of the flexible portion 102 relative to the inflexible portion 104. Similarly, the protrusion 336 and the groove 334 are configured to cooperate to prevent axial displacement of the flexible portion 102 relative to the inflexible portion 104.

Figure 4:
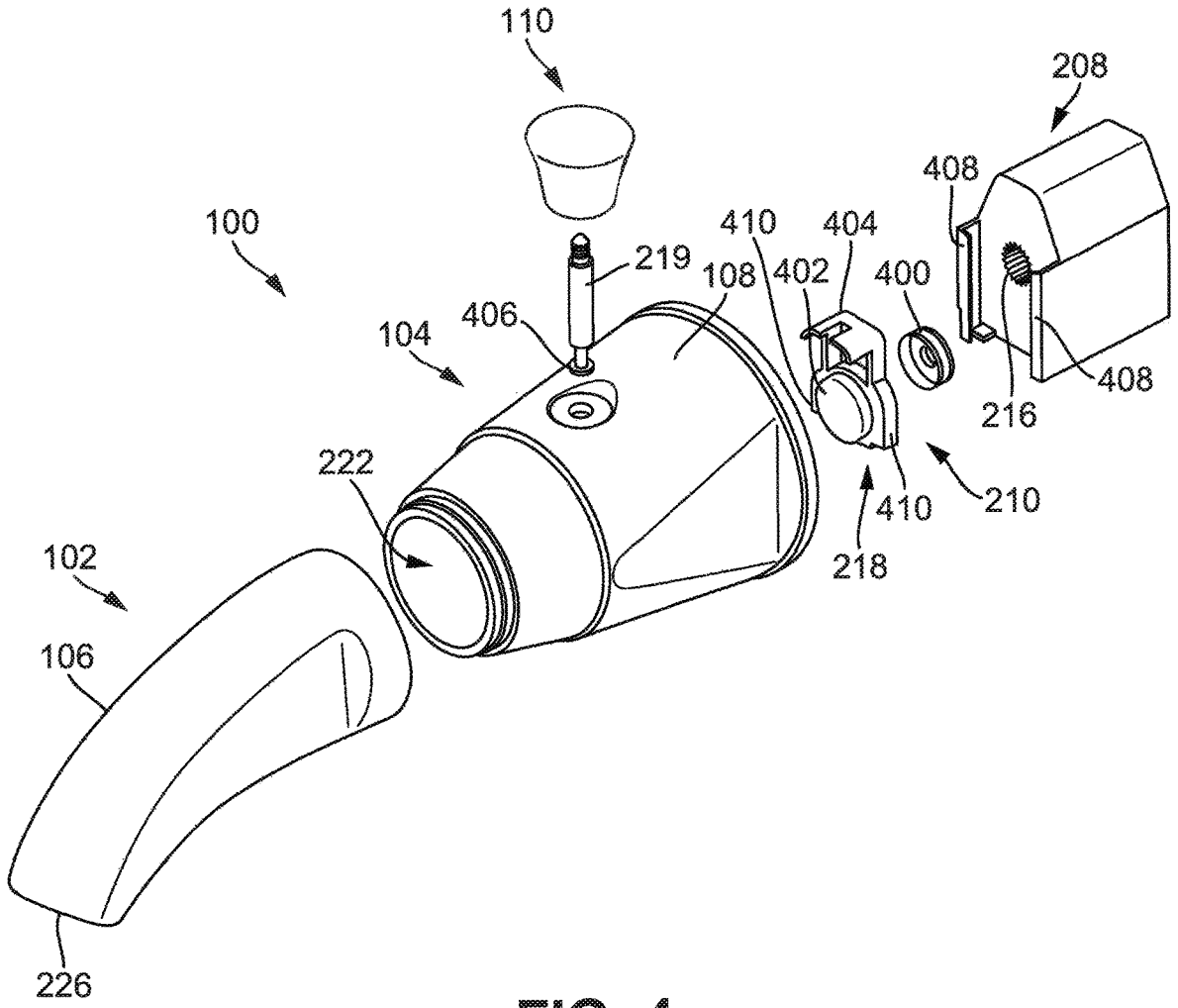
FIG. 4 is an exploded view of the tub spout of FIG. 1.

FIG. 4 illustrates an exploded view of the tub spout 100. The diverter assembly 210 includes a seal (e.g., sealing member, disk, etc.), shown as a seal 400. The seal 400 is positioned within a receptacle (e.g., receiver, etc.), shown as a receptacle 402, in the gate 218. The gate 218 also includes an extension (e.g., projection, protrusion, etc.), shown as a slotted extension 404. The shaft 219 includes a head, shown as a head 406. The head 406 is configured to be received within the slotted extension 404 such that movement of the shaft 219 is transferred to the gate 218 through an interaction between the head 406 and the slotted extension 404.

The fitting 208 includes rails (e.g., guides, tracks, etc.), shown as rails 408. The rails 408 are vertically disposed along opposite sides of the fitting 208. The gate 218 also includes projections, shown as projections 410. Each of the projections 410 is configured to be received within one of the rails 408 such that repositioning of the gate 218 (e.g., between the first state and the second state, etc.) causes repositioning the projections 410 within the rails 408. Additionally, each the rails 408 maintains the gate 218 relative to the fitting 208. Specifically, when the gate 218 is prohibiting the flow of water, the pressure of the water in the fitting 208 is transferred to the gate 218, which further transfers that pressure to the rails 408, which further transfers that pressure to the fitting 208, which further transfers that pressure to the plumbing fixture and to the inner wall 211, which finally transfers that pressure to the wall upon which the tub spout 100 is mounted.

As shown in FIG. 4, the fitting 208 is shaped as an irregular hexagon. While not shown, the receiver 202 has a corresponding shape such that water is prevented from flowing between the fitting 208 and the receiver 202.

While the fitting 208 has been described and illustrated as separate from the inflexible portion 104, it is understood that the fitting 208 could be integrated into the inflexible portion 104. For example, the inflexible portion 104 could be machined to include the fitting 208 or the fitting 208 could be placed into a mold and the inflexible portion 104 could be formed around the fitting 208, such that the fitting 208 is integrated into the inflexible portion 104. In such an embodiment, the gate 218 would be inserted into the inflexible portion 104 via the outlet 222, and the rails 408 and/or projections 410 would facilitate coupling of the gate 218 to the fitting 208 inside of the inflexible portion 104.

Figure 5:
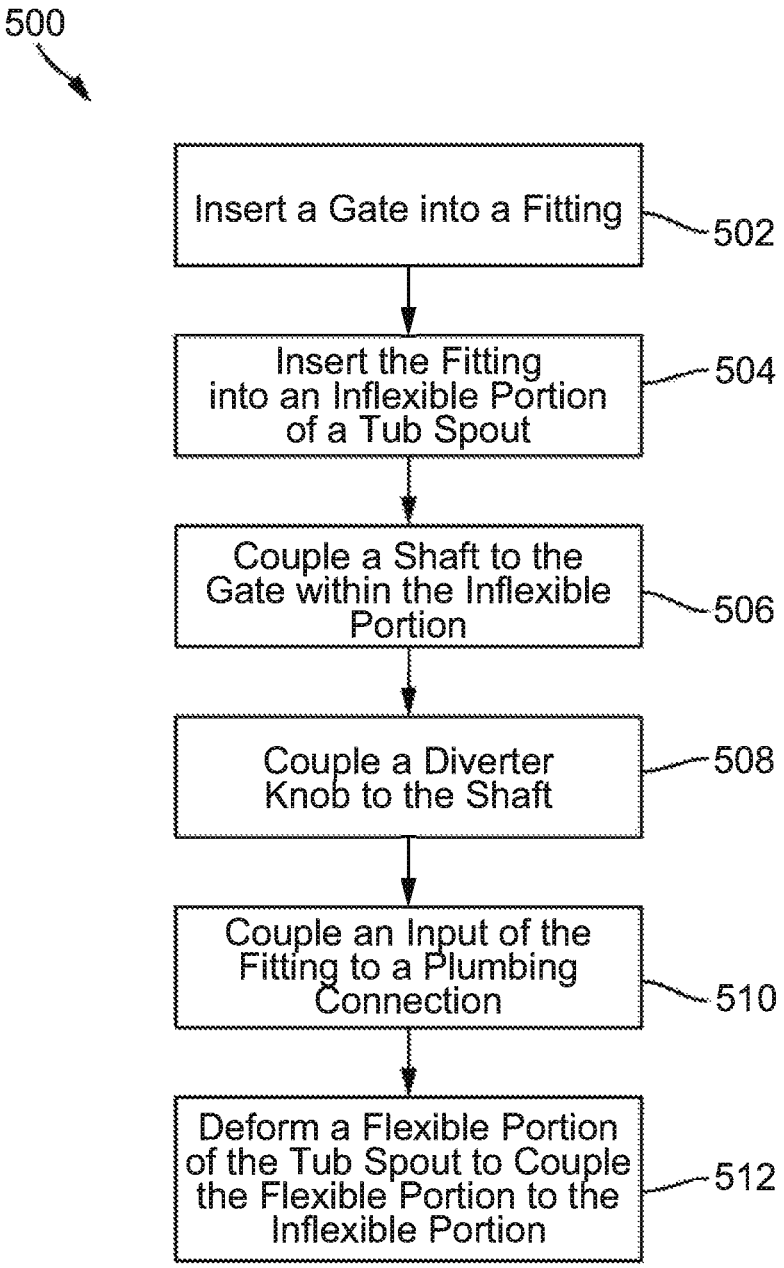
FIG. 5 is a flow chart for a process of assembling the tub spout of FIG. 1, according to an exemplary embodiment of the present disclosure.

FIG. 5 illustrates a process (e.g., method, etc.), shown as a process 500, for installing the tub spout 100. The process 500 begins, in block 502, with inserting a gate 218 into a fitting 208. For example, the gate 218 may be inserted into the fitting 208 such that the projections 410 are received in the rails 408. The process 500 continues, in block 504, with inserting the fitting 208 into the inflexible portion 104. For example, the fitting 208, along with the gate 218, may be inserted into the inflexible portion 104 via the receiver 202 such that the fitting 208 contacts the inner wall 211. When the fitting 208 is inserted in the receiver 202, the outlet 216 is configured to be aligned with the gate 218 and the fitting 208 interfaces with the diverter assembly 210 such that substantially no gap exists between the fitting 208 and the receiver 202, such as between the inner surface 206 and the fitting 208.

Next, the process 500 continues, in block 506, with coupling a shaft 219 to the gate 218 within the inflexible portion 104. For example, the shaft 219 may be inserted through an aperture in the exterior surface 108 and coupled to the gate 218 by locating the head 406 within the slotted extension 404.

The process 500 continues, in block 508, with coupling a diverter knob 110 to the shaft 219. For example, the diverter knob 110 may be threaded onto the shaft 219. When the diverter knob 110 is coupled to the shaft 219, movement of the diverter knob 110 is transferred to the gate 218 through the shaft 219. It is understood that, in some embodiments, block 508 and block 506 are interchanged (e.g., the diverter knob 110 is coupled to the shaft 219 before the fitting 208 is inserted into the receiver 202, etc.).

The process 500 continues, in block 510, with coupling an input 214 to a plumbing fixture protruding from a wall. For example, a threaded pipe fitting may protrude from a shower wall, and the input 214 may be threaded onto the threaded pipe fitting. When the input 214 is coupled to the plumbing fixture, the mounting face 200 of the inflexible portion 104 may be flush with the wall from which the plumbing fixture protrudes. Calk or sealant may be utilized to seal an interface between the mounting face 200 and the wall.

The process 500 continues, in block 512, with deforming a flexible portion 102 to couple the flexible portion 102 to the inflexible portion 104. Specifically, the flexible portion 102 is deformed such that a protrusion 322 of the flexible portion 102 is received within a groove 324 of the inflexible portion 104 and such that a protrusion 336 of the inflexible portion 104 is received within a groove 334 of the flexible portion 102. After block 512, the tub spout 100 is assembled and capable of receiving water therethrough.

VI. Configuration of Exemplary Embodiments

As utilized herein, the terms "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "prevent" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

The terms "coupled," "connected," "fastened," "attached," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "upper," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the flexible portion 102, the inflexible portion 104, the diverter assembly 210, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A tub spout comprising:

a fitting configured to be coupled to a plumbing fixture and to receive water from the plumbing fixture;

an inflexible portion configured to receive the fitting or configured to have the fitting integrated therein, be held adjacent a wall by the plumbing fixture, and receive the water from the plumbing fixture, the inflexible portion comprising:

an outlet through which the water is selectively provided; and a first protrusion extending around the outlet; and a flexible portion configured to be coupled to an exterior surface of the inflexible portion, extend from the inflexible portion, selectively receive the water from the inflexible portion, and selectively provide the water out of the tub spout, the flexible portion comprising a first groove extending around the flexible portion, the first groove configured to receive the first protrusion when the flexible portion is coupled to the inflexible portion.

2. The tub spout of claim 1, wherein:

the flexible portion comprises a second protrusion extending about the flexible portion;

the inflexible portion comprises a second groove extending about the inflexible portion; and the second groove is configured to receive the second protrusion when the flexible portion is coupled to the inflexible portion.

3. The tub spout of claim 2, wherein the first protrusion is positioned between the second groove and the outlet.

4. The tub spout of claim 2, wherein:

the first protrusion is contiguous with the second groove; and the second protrusion is contiguous with the first groove.

5. The tub spout of claim 1, wherein:
the inflexible portion is constructed from a first material and has a first aesthetic appearance;
the flexible portion is constructed from a second material and has a second aesthetic appearance;
the first material is different from the second material; and
the first aesthetic appearance is different from the second aesthetic appearance.

6. The tub spout of claim 5, wherein:
the first material is metal or plastic; and
the second material is silicone or rubber.

7. The tub spout of claim 5, wherein the first aesthetic appearance is chrome plated or brushed metal.

8. The tub spout of claim 1, wherein:
the flexible portion is configured to elastically deform relative to the wall when the flexible portion is coupled to the inflexible portion, the fitting is coupled to the plumbing fixture, and the fitting is received in or integrated in the inflexible portion; and
the inflexible portion is configured to not elastically deform relative to the wall when the fitting is coupled to the plumbing fixture and the fitting is received in or integrated in the inflexible portion.

9. A tub spout comprising:
an inflexible portion configured to be held adjacent a wall, the inflexible portion comprising:
an outlet through which the water is selectively provided;
a first groove extending around the outlet; and
a fitting configured to be coupled to a plumbing fixture and to receive water from the plumbing fixture, the fitting configured to hold the inflexible portion adjacent the wall through the plumbing fixture;
a flexible portion configured to be coupled to and extend from the inflexible portion, selectively receive the water from the inflexible portion, and selectively provide the water out of the tub spout, the flexible portion comprising a first protrusion extending about the flexible portion, the first protrusion configured to be received within the first groove such that the flexible portion is coupled to the inflexible portion; and
a diverter assembly configured to be coupled to the inflexible portion between the fitting and the flexible portion, the diverter assembly comprising a gate configured to be positioned within the inflexible portion, the gate operable between a first position where the water is capable of flowing from the inflexible portion to the flexible portion and a second position where the water is prohibited from flowing from the inflexible portion to the flexible portion.

10. The tub spout of claim 9, wherein:
the flexible portion comprises a second groove extending about the flexible portion;
the inflexible portion comprises a second protrusion extending about the inflexible portion; and
the second groove is configured to receive the second protrusion such that the flexible portion is coupled to the inflexible portion.

11. The tub spout of claim 9, wherein:
the inflexible portion is constructed from a first material and has a first aesthetic appearance;
the flexible portion is constructed from a second material and has a second aesthetic appearance;
the first material is different from the second material; and
the first aesthetic appearance is different from the second aesthetic appearance.

12. The tub spout of claim 11, wherein:
the first material is metal or plastic; and
the second material is silicone or rubber.

13. The tub spout of claim 11, wherein the first aesthetic appearance is chrome plated or brushed metal.

14. The tub spout of claim 9, wherein:
the flexible portion is configured to elastically deform relative to the wall when the flexible portion is coupled to the inflexible portion, the fitting is coupled to the plumbing fixture, and the fitting is received in or integrated in the inflexible portion; and
the inflexible portion is configured to not elastically deform relative to the wall when the fitting is coupled to the plumbing fixture and the fitting is received in or integrated in the inflexible portion.

15. A tub spout comprising:
an inflexible portion configured to be coupled to a plumbing fixture, receive water from the plumbing fixture, and be held adjacent a wall through the plumbing fixture, the inflexible portion comprising:
an outlet; and
a first groove disposed around the outlet;
a flexible portion configured to be coupled to and extend from the inflexible portion, selectively receive the water from the inflexible portion, and selectively provide the water out of the tub spout, the flexible portion comprising a first protrusion extending about the flexible portion; and
a diverter assembly configured to be coupled to the inflexible portion between a fitting and the flexible portion and operable between a first position where water is capable of being provided from the inflexible portion to the flexible portion and a second position where water is prohibited from being provided from the inflexible portion to the flexible portion;
wherein the first groove is configured to receive the first protrusion such that the flexible portion is coupled to the inflexible portion.

16. The tub spout of claim 15, wherein:
the flexible portion comprises a second groove extending about the flexible portion;
the inflexible portion comprises a second protrusion extending about the inflexible portion; and
the second groove is configured to receive the second protrusion such that the flexible portion is coupled to the inflexible portion.

17. The tub spout of claim 15, wherein:
the inflexible portion is constructed from a first material and has a first aesthetic appearance;
the flexible portion is constructed from a second material and has a second aesthetic appearance;
the first material is different from the second material; and
the first aesthetic appearance is different from the second aesthetic appearance.

18. The tub spout of claim 15, wherein:
the flexible portion is configured to elastically deform relative to the wall when the inflexible portion is held adjacent the wall and the flexible portion is coupled to the inflexible portion; and
the inflexible portion is configured to not elastically deform relative to the wall when the inflexible portion is held adjacent the wall.

* * * * *